US010170837B2

(12) United States Patent
Toh et al.

(10) Patent No.: US 10,170,837 B2
(45) Date of Patent: Jan. 1, 2019

(54) SEGMENTED ANTENNA

(71) Applicant: Futurewei Technologies, Inc., Plano, TX (US)

(72) Inventors: Wee Kian Toh, San Diego, CA (US); Daejoung Kim, San Diego, CA (US); Shing Lung Steven Yang, San Diego, CA (US); Ping Shi, San Diego, CA (US)

(73) Assignee: Futurewei Technologies, Inc., Plano, TX (US)

( * ) Notice: Subject to any disclaimer, the term of this patent is extended or adjusted under 35 U.S.C. 154(b) by 106 days.

(21) Appl. No.: 13/792,613

(22) Filed: Mar. 11, 2013

(65) Prior Publication Data

US 2014/0253406 A1 Sep. 11, 2014

(51) Int. Cl.

| | |
|---|---|
| ***H01Q 9/04*** | (2006.01) |
| ***H01Q 7/00*** | (2006.01) |
| ***H01Q 1/24*** | (2006.01) |
| ***H01Q 9/42*** | (2006.01) |

(52) U.S. Cl.

CPC ..... *H01Q 9/0407* (2013.01); *H01Q 1/243* (2013.01); *H01Q 7/00* (2013.01); *H01Q 9/42* (2013.01)

(58) Field of Classification Search

CPC ..... H01Q 9/04–9/0407; H01Q 1/243; H01Q 7/00; H01Q 9/42

USPC ..... 343/867, 700, 866, 702

See application file for complete search history.

(56) References Cited

U.S. PATENT DOCUMENTS

| | | | | |
|---|---|---|---|---|
| 8,111,150 | B2 * | 2/2012 | Miller | A61B 5/0031 334/5 |
| 8,378,899 | B2 * | 2/2013 | Galeev | 343/702 |
| 8,779,988 | B2 * | 7/2014 | Yang et al. | 343/700 MS |
| 9,608,331 | B1 * | 3/2017 | Rowson | H01Q 9/16 |
| 2004/0075613 | A1 * | 4/2004 | Jarmuszewski | H01Q 1/243 343/702 |
| 2011/0109514 | A1 * | 5/2011 | Galeev | H01Q 1/243 343/702 |
| 2012/0182186 | A1 * | 7/2012 | Yang | H01Q 1/243 343/700 MS |

OTHER PUBLICATIONS

Han, C., et al., "Wireless Communication Device with an Antenna Adjacent to an Edge of the Device," U.S. Appl. No. 13/278,836, filed Oct. 21, 2011, 34 pages.

(Continued)

*Primary Examiner* — Dameon E Levi
*Assistant Examiner* — Hasan Islam
(74) *Attorney, Agent, or Firm* — Conley Rose, P.C.

(57) ABSTRACT

An antenna comprising a main arm comprising conductive material, wherein the main arm is connected to a signal feed, and a first coupling arm comprising conductive material, wherein the first coupling arm is electrically coupled to a ground, and wherein the first coupling arm is electrically coupled to the main arm across a first span of nonconductive material. Also disclosed is a mobile node (MN) comprising a signal feed, a ground, and an antenna comprising a main arm comprising conductive material, wherein the main arm is connected to the signal feed, and a first coupling arm comprising conductive material, wherein the first coupling arm is connected to the ground, and wherein the first coupling arm is electrically coupled to the main arm across a first span of nonconductive material.

10 Claims, 7 Drawing Sheets

(56) References Cited

OTHER PUBLICATIONS

Filipovic, D., et al., "A Coupled-Segment Quadrifilar Helical Antenna," IEEE, 1997, pp. 43-46.
Ravipati, C.B., et al., "The Goubau Multi Element Monopole Antenna—Revisited," IEEE, 2007, pp. 233-236.
Qing, X., et al., "Segmented Spiral Antenna for UHF Near-Field RFID," IEEE, 2011, pp. 996-999.
Gummalla, A., et al., "Compact Dual-Band Planar Metamaterial Antenna Arrays for Wireless LAN," IEEE, 2008, 4 pages.
Gummalla, A., et al., "Compact Metamaterial Quad-Band Antenna for Mobile Application," IEEE, 2008, 4 pages.

* cited by examiner

SEGMENTED ANTENNA

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Mobile nodes (MNs) may wirelessly transmit signals to corresponding external components via an antenna. When in use, the antenna may generate an electromagnetic field (E-field) which may interfere with internal electromagnetic components positioned in close proximity to the antenna. As a result, MNs may comprise a keep-out region around the antenna, which may be a region that may not comprise electromagnetic components. The increasing sophistication of MNs, along with the push for miniaturization, may further reduce the area available for such electromagnetic components.

SUMMARY

In one embodiment, the disclosure includes an antenna comprising a main arm comprising conductive material, wherein the main arm is connected to a signal feed, and a first coupling arm comprising conductive material, wherein the first coupling arm is electrically coupled to a ground, and wherein the first coupling arm is electrically coupled to the main arm across a first span of nonconductive material.

In another embodiment, the disclosure includes a mobile node (MN) comprising a signal feed, a ground, and an antenna comprising a main arm comprising conductive material, wherein the main arm is connected to the signal feed, and a first coupling arm comprising conductive material, wherein the first coupling arm is connected to the ground, and wherein the first coupling arm is electrically coupled to the main arm across a first span of nonconductive material.

These and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that, although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein is a segmented antenna with a controlled E-field that may allow unrelated electromagnetic components to be located in close proximity to the antenna. The segmented antenna may comprise a main arm and a first coupling arm separated by a span of nonconductive material. The segmented antenna may also comprise a second coupling arm which may also be separated from the main arm by a span of nonconductive material. The first coupling arm and/or the second coupling arm may be connected and/or coupled to a ground. When operational, the main arm may induce current(s) in the first coupling arm and/or the second coupling arm. As current may move toward a ground and as the coupling arm(s) may be connected to a ground, an E-field created across a span may point in the direction of the associated coupling arm. As the position of the nonconductive spans may be known at the time of design, the direction and position of the E-field(s) may also be known. The unrelated electromagnetic components may be positioned between the antenna arms in the traditional keep out region while being positioned out of the path of the E-fields. Also, the position of the nonconductive span(s) may be adjusted to move the associated E-fields away from electromagnetic components as needed without significantly impacting antenna performance. The coupling arm(s) may be extendable which may provide for ease of antenna tuning at the time of design. The antenna may also comprise additional coupling arms connected to the ground via a switch. The switch may be operated to dynamically adjust the antenna's transmission characteristics during use.

Figure 1:
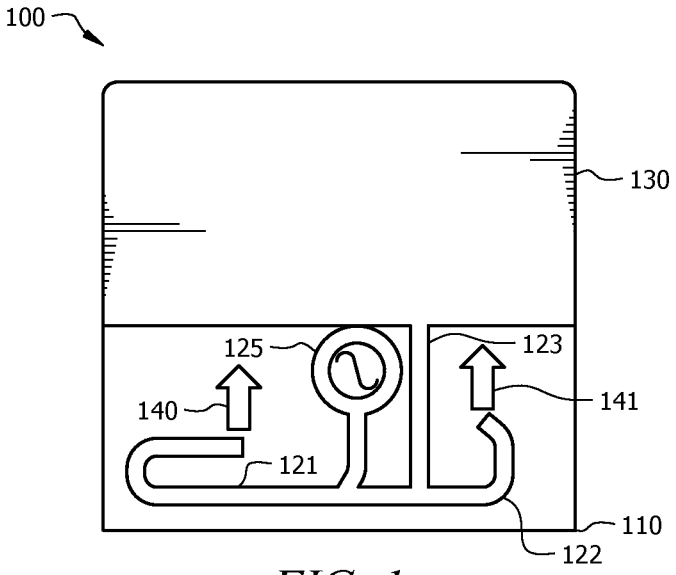
FIG. 1 is a schematic diagram of an embodiment of an inverted F antenna (IFA).

FIG. 1 is a schematic diagram of an embodiment of an IFA 100. The IFA 100 may comprise a low band arm 121 and a high band arm 122, which may be tuned to transmit wireless signals for low frequency bands and high frequency bands, respectively. The IFA 100 may also comprise a signal feed 125 for transmitting electrical signals to arm 121 and/or 122 for wireless transmission, a ground plane 130, and a ground trace 123 connected to the high band arm 122. When in use, electrical signals entering the low band arm 121 may induce an E-field 140 between the low band arm 121 and the ground plane 130. This may occur because the E-field 140 may be the closest path to the ground plane 130 for electrical signals on the low band arm 121. Similarly, an E-field 141 may also be created between the high band arm 122 and the ground plane 130. E-fields 140 and 141 may interfere with any electromagnetic components placed between the ground plane 130 and either the high band arm 122 or the low band arm 121. IFA 100 may therefore comprise a keep out region 110, which may be an area that comprises significant E-fields such as E-fields 140 and/or 141. If other electromagnetic components are positioned in the keep out region 110, the E-fields present in the region 110 may negatively affect the performance of the antenna and/or electromagnetic components. For example, a speaker positioned in the keep out region may emit the E-fields as sound, which may result in an unusable speaker. Such electromagnetic components may also alter the electrical characteristics of the IFA 100.

Figure 2:
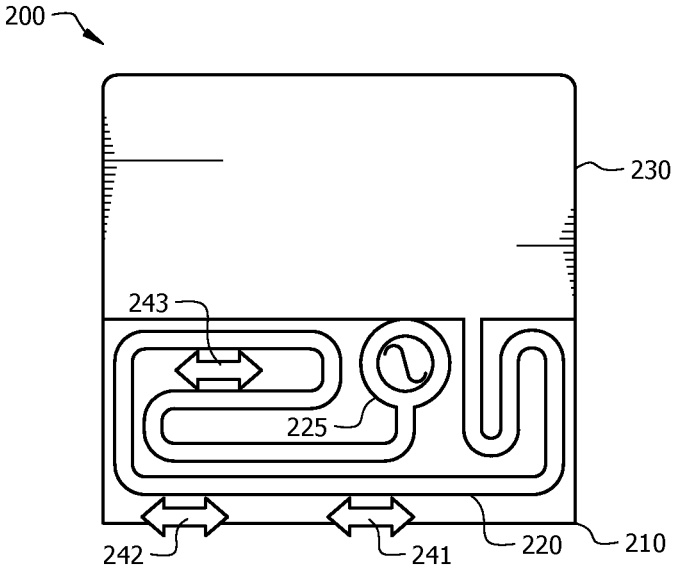
FIG. 2 is a schematic diagram of an embodiment of a loop antenna.

FIG. 2 is a schematic diagram of an embodiment of a loop antenna 200. Loop antenna 200 may comprise a loop 220 of conductive material connecting a signal feed 225 to a ground plane 230. Electrical signals passing along loop 220 may create E-fields 241, 242, and/or 243. The position, direction, number, and/or intensity of E-fields 241-243 may be a function of the frequency of the electrical signals transmitted by the signal feed 225. E-fields 241-243 may therefore change during use because loop antenna 200 may be employed to transmit a broad range of signals. The exact position, direction, number, and/or intensity of E-fields 241-243 may not be known when the antenna 200 is initially designed. Antenna 200 may therefore comprise a keep out region 210 comprising the area where E-fields 241-243 might affect the function of other electromagnetic components.

Figure 3:
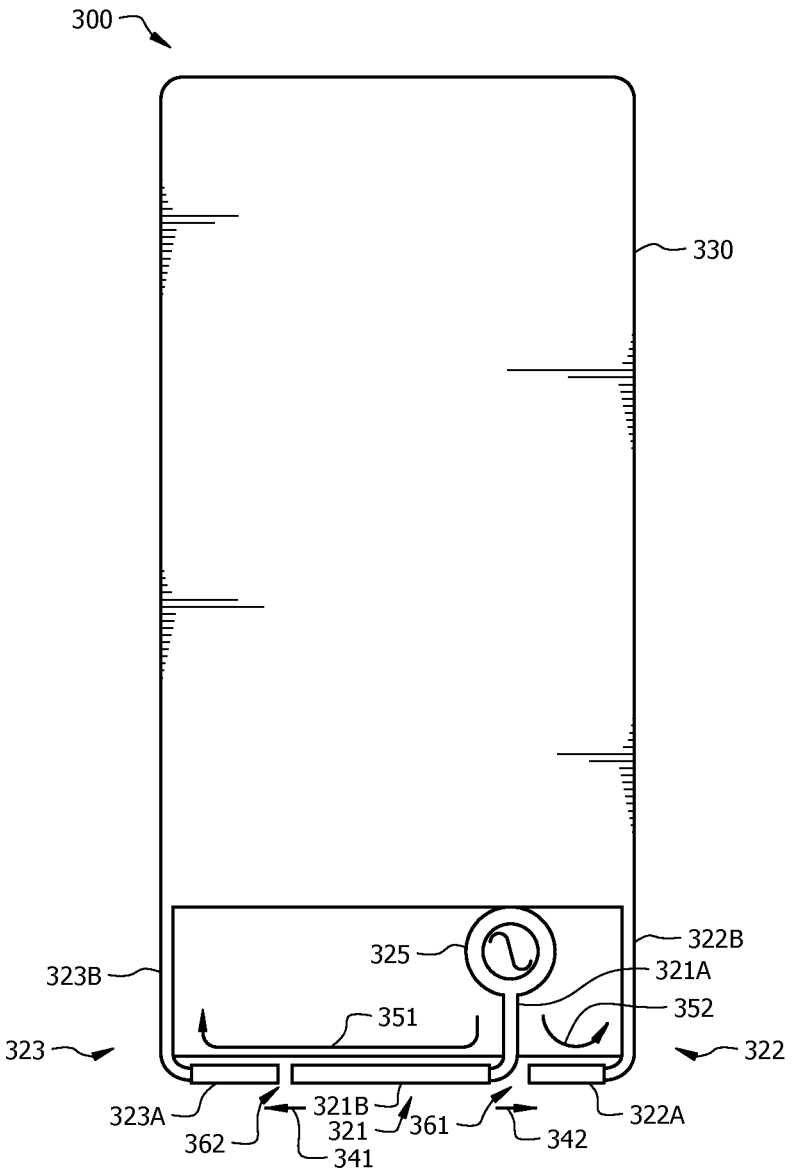
FIG. 3 is a schematic diagram of an embodiment of a segmented antenna.

FIG. 3 is a schematic diagram of an embodiment of a segmented antenna 300. Segmented antenna 300 may comprise a main arm 321 comprising conductive material. The main arm 321 may comprise a proximate section 321A which may be connected to a signal feed 325 and a distal section 321B which may be substantially perpendicular to the proximate section 321A. Antenna 300 may further comprise a first coupling arm 322 comprising conductive material, which may be tuned to transmit high band wireless signals (e.g. greater than about 1000 megahertz (MHz)). The first coupling arm 322 may comprise a proximate section 322A and a distal section 322B which may be substantially perpendicular to the proximate section 322A and may be connected and/or coupled to a ground plane 330. The proximate section 322A of the first coupling arm 322 may be separated from the main arm 321 by a first span of nonconductive material 361. The signal feed 325 may transmit electrical current 352 into the main arm 321. The electrical current 352 may traverse the first nonconductive span 361 by inducing a current in the first coupling arm 322, which may create an E-field 342. The main arm 321 may be coupled to the first coupling arm 322 by the E-field 342. The electrical current 352 may take the path of least impedance between the main arm 321 and the ground plane 330. As such, the E-field 342 may be predictably located across the nonconductive span 361 and may consistently point towards the first coupling arm 322 as the path of least impedance toward the ground plane 330 for electrical current 352 may be across the first coupling arm 322. The nonconductive span 361 may act as an area of high impedance, which may also be referred to as a high impedance locus.

Antenna 300 may further comprise a second coupling arm 323 comprising conductive material, which may be tuned to transmit low band wireless signals (e.g. less than and/or equal to about 1000 MHz). The second coupling arm 323 may comprise a proximate section 323A and a distal section 323B which may be substantially perpendicular to the proximate section 323A and may be connected and/or coupled to ground plane 330. The proximate section 323A of the second coupling arm 323 may be separated from the distal section 321B of main arm 321 by a second span of nonconductive material 362. The electrical signals transmitted by signal feed 325 may branch into electrical current 351. The electrical current 351 may traverse the second nonconductive span 362 by inducing a current in the second coupling arm 323, which may create an E-field 341. The main arm 321 may be coupled to the second coupling arm 323 by the E-field 341 in a substantially similar manner to the coupling with the first coupling arm 322 via E-field 342. The electrical current 351 may take the path of least impedance between the main arm 321 and the ground plane 330. As such, the E-field 341 may be predictably located across the nonconductive span 362 and may consistently point towards the second coupling arm 323 as the path of least impedance toward the ground plane 330 for electrical current 351 may be across the second coupling arm 323. The second nonconductive span 362 may act as an area of high impedance (e.g. a high impedance locus). Nonconductive spans 361 and 362 may be collectively referred to as high impedance loci. As shown in FIG. 3, the high impedance loci and associated E-fields 341 and 342 may be positioned in parallel.

The main arm 321, first coupling arm 322, and second coupling arm 323 may be arranged in a loop and/or broken loop pattern as shown in FIG. 3. The arrangement may position the first coupling arm 322, second coupling arm 323, nonconductive spans 361 and/or 362, and associated E-fields 342 and/or 341 around the edges of an MN and away from the main arm 321. As such, the area inside the loop and/or broken loop pattern may be relatively free of E-fields, which may allow additional electromagnetic components to be positioned inside the loop and/or broken loop (e.g. between the main arm 321 and the first coupling arm 322 and/or between the main arm 321 and the second coupling arm 323). The nonconductive spans 361/362 may be moved to different positions on the loop/broken loop as needed to move E-fields 342 and/or 341 away from particular electromagnetic components positioned inside the loop/broken loop in specific embodiments. Additional nonconductive spans may be positioned on the loop/broken loop as needed to tune the antenna for different types of transmissions. The length of main arm 321, first coupling arm 322, an/or second coupling arm 323 may also be adjusted for tuning by fluctuating the conductive material while maintaining the general loop/broken loop structure of antenna 300 as discussed with respect to FIG. 4. Such adjustments may be made without significantly introducing E-fields to the interior of the loop/broken loop.

Figure 4:
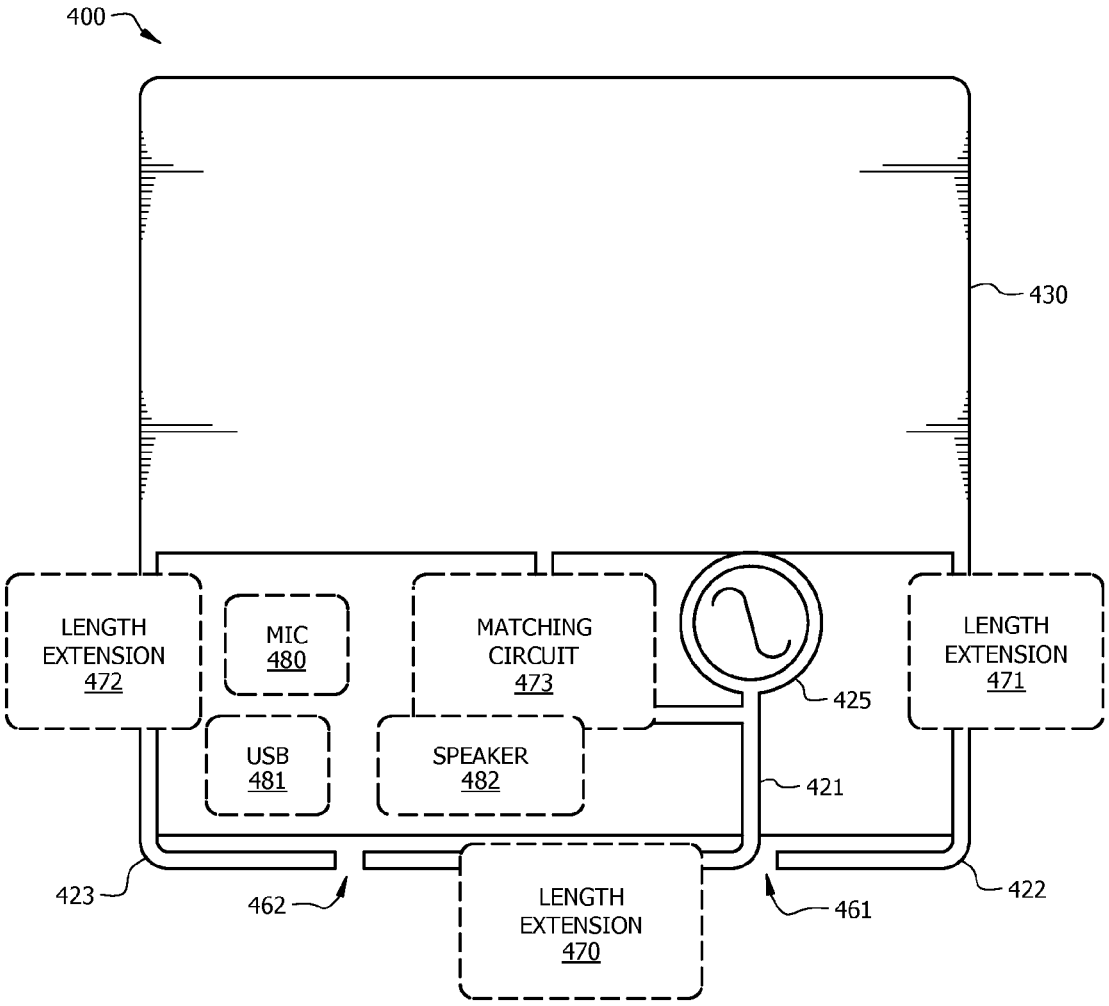
FIG. 4 is a schematic diagram of another embodiment of a segmented antenna.

FIG. 4 is a schematic diagram of another embodiment of a segmented antenna 400. Antenna 400 may comprise a main arm 421, first coupling arm 422, second coupling arm 423, ground plane 430, signal feed 425, nonconductive span 461, and nonconductive span 462, which may be substantially similar to main arm 321, first coupling arm 322, second coupling arm 323, ground plane 330, signal feed 325, nonconductive span 361, and nonconductive span 362. Antenna 400 may also comprise length extensions 470, 471, and/or 472, which may be employed to tune antenna 400 for beneficial performance when transmitting wireless signals for specified frequencies. Length extensions 470, 471, and/or 472 may be portions of nonconductive material (e.g. trace) that may extend in the direction of the main arm 421, the first coupling arm 422, and/or second coupling arm 423, respectively on a specified axis (e.g. an x axis), but may also extend in one or more other axes (e.g. y axis and/or z axis) for the purpose of increasing the length of the nonconductive material trace for antenna tuning. Length extensions 470, 471, and/or 472 may create additional E-fields, but such E-fields may be positioned at the edge of the loop/broken loop structure bounded by the main arm 421, first coupling arm 422, second coupling arm 423, and combinations thereof.

Maintaining the E-fields (e.g. E-field 461, 462, etc.) at the arms 421, 422, and/or 423 may allow electromagnetic components configured to perform functions unrelated to the antenna 400 to be positioned between the main arm 421 and the first coupling arm 422, between the main arm 421 and the second coupling arm 423, and combinations thereof. Speaker 482, microphone 480, and/or universal serial bus (USB) device 481 may be some examples of electromagnetic components configured to perform functions unrelated to the antenna 400 that may be positioned inside the loop/broken loop. It should be noted that speaker 482, microphone 480, and/or USB device 481 are only example electromagnetic components and many other electromagnetic components may be positioned between the main arm 421 and the first coupling arm 422, between the main arm 421 and the second coupling arm 423, and combinations thereof.

Antenna 400 may further comprise a matching circuit 473, which may be electrically connected and/or coupled to the main arm 421 and the ground plane 430. The matching circuit 473 may comprise, for example, a trace of conductive material, a capacitor, an inductor, and/or combinations thereof, and may be configured to match an impedance associated with antenna 400 with an impedance associated with other components involved with wireless transmission (e.g. an amplifier). Impedance matching may reduce the amount of power reflected back into a circuit connected to antenna 400 and consequently not transmitted as part of a wireless signal. The matching circuit 473 may be positioned between the main arm 421 and the second coupling arm 423, as shown, or between the main arm 421 and the first coupling arm 422 as needed for an embodiment.

Figure 5:
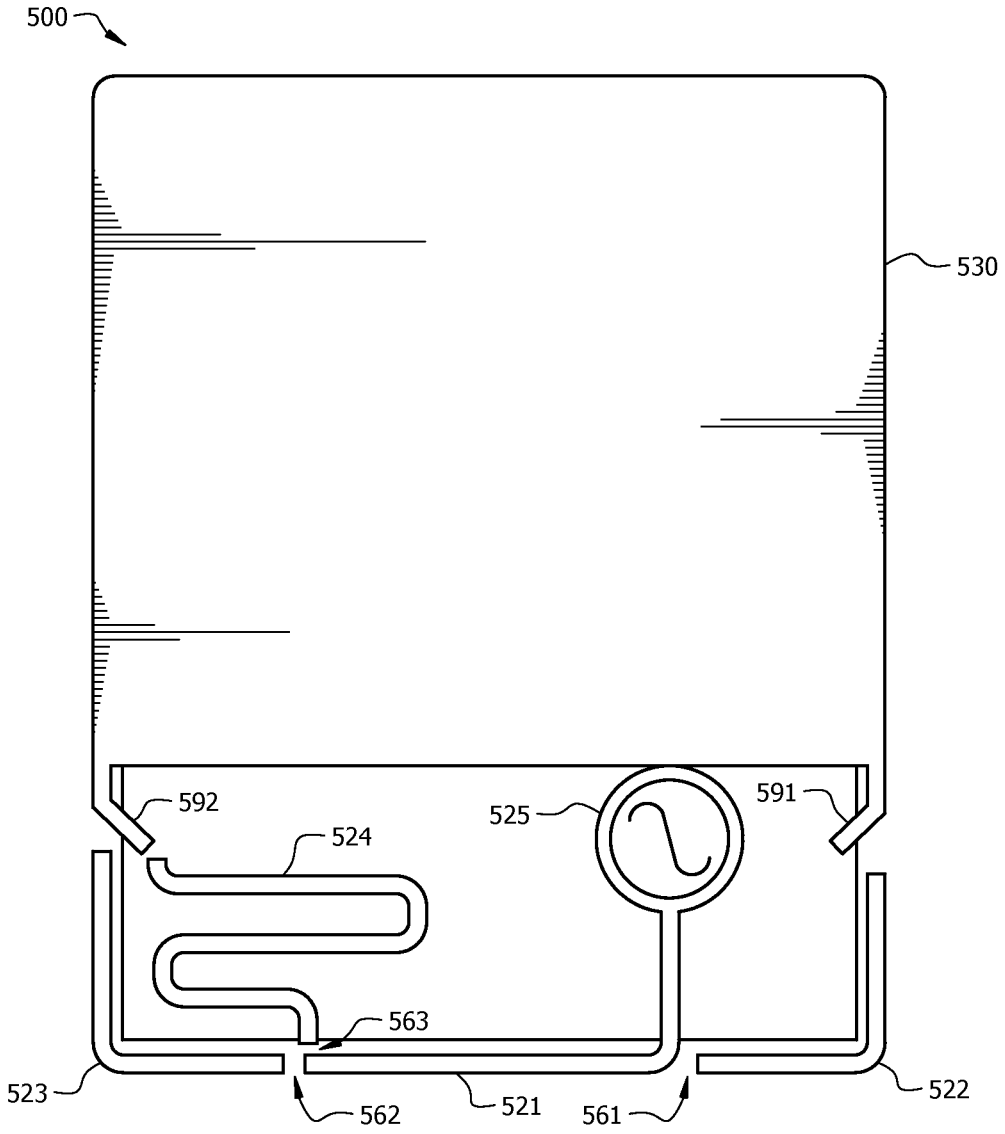
FIG. 5 is a schematic diagram of another embodiment of a segmented antenna.

FIG. 5 is a schematic diagram of another embodiment of a segmented antenna 500. Antenna 500 may comprise a main arm 521, first coupling arm 522, second coupling arm 523, ground plane 530, signal feed 525, nonconductive span 561, and nonconductive span 562, which may be substantially similar to main arm 321, first coupling arm 322, second coupling arm 323, ground plane 330, signal feed 325, nonconductive span 361, and nonconductive span 362. Antenna 500 may further comprise third coupling arm 524 of conductive material, which may be separated from the main arm 521 by a third span of nonconductive material 563. The second coupling arm 523 and the third coupling arm 524 may be connected and/or coupled to the ground plane 530 by a switch 592. The switch 592 may be toggled from a first position to connect and/or couple the second coupling arm 523 to the ground plane 530 and/or toggled to a second position to connect and/or couple the third coupling arm 524 to the ground plane 530. The main arm 521 may be coupled to whichever coupling arm is connected and/or coupled to the ground plane 530 via the switch 592 at a specified time. Antenna 500 may further comprise switch 591, which may connect and/or couple the first coupling arm 522 to the ground plane 530 when the switch is in a first position and disconnect and/or uncouple to the first coupling arm 522 from the ground plane 530 when the switch is in a second position.

As such, the switch 591 and/or 592 may be toggled to dynamically alter the shape of an active portion of antenna 500 (and the associated tuning) based on conditions detected by an antenna controller (e.g. a processor) at a specified time. For example, switches 591 and/or 592 may be toggled during antenna 500 use to retune antenna 500 for a specific wireless transmission, reduce an Envelope Correlation Coefficient (ECC) associated with antenna 500, reduce a specific absorption rate (SAR) associated with the antenna 500, etc. Such toggling may allow the electrical characteristics of antenna 500 to be dynamically altered as needed for better transmission at predetermined frequencies and/or to comply with safety regulations.

Figure 6A:
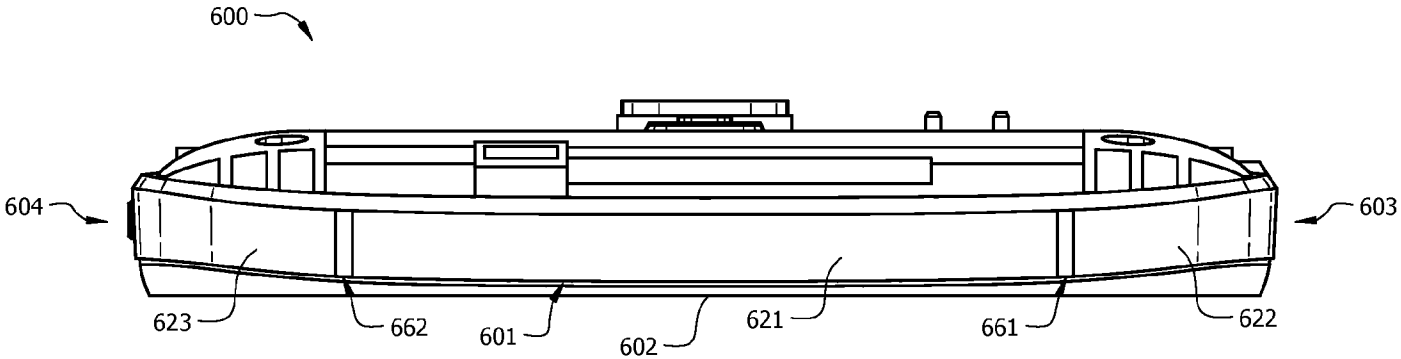
FIGS. 6A-6B illustrate an embodiment of a MN comprising a segmented antenna interacting with a user's hand.
Figure 6B:
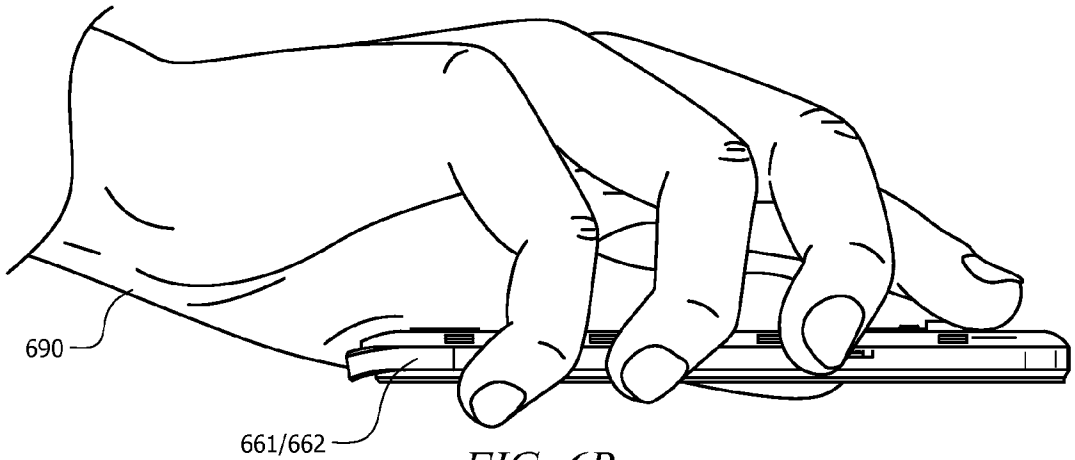

FIGS. 6A-6B illustrate an embodiment of a MN 600 comprising a segmented antenna 601 interacting with a user's hand 690. Antenna 600 may comprise a main arm 621, first coupling arm 622, second coupling arm 623, nonconductive span 661, and nonconductive span 662, which may be substantially similar to main arm 321, first coupling arm 322, second coupling arm 323, nonconductive span 361, and nonconductive span 362. The components of antenna 601 may be positioned on the outer surface of MN 600 or inside a MN 600 casing. As shown in FIG. 6, a user may grip MN 600 by placing a palm of hand 690 near the lower edge 602 and placing fingers and/or a thumb on a right edge 603 of the MN 600 and/or a left edge 604 of MN 600, respectively. Nonconductive spans 662 and/or 661 may be positioned at a lower edge 602 of the MN 600 to position the spans 662 and/or 661 in positions with reduced direct contact with hand 690. Reducing direct contact with the user's hand 690 may reduce inefficiencies in the transmission of wireless signals that may result if a user's hand 690 partially shorts nonconductive span 662 and/or 661. Any effects related to such shorting may be minimal as the conductive material of antenna 600 may be a better electrical path then the user's hand 690, which may act as a dielectric and/or insulator. As another example, antenna 600 may comprise a switching system substantially similar to antenna 500, which may be employed to change the shape of antenna 600 in response to a detected power loss associated with a partial short related to a user's hand 690. It should be noted that the terms lower, left, and right are used herein for the purposes of clarity of discussion and should not be considered limiting.

Figure 7:
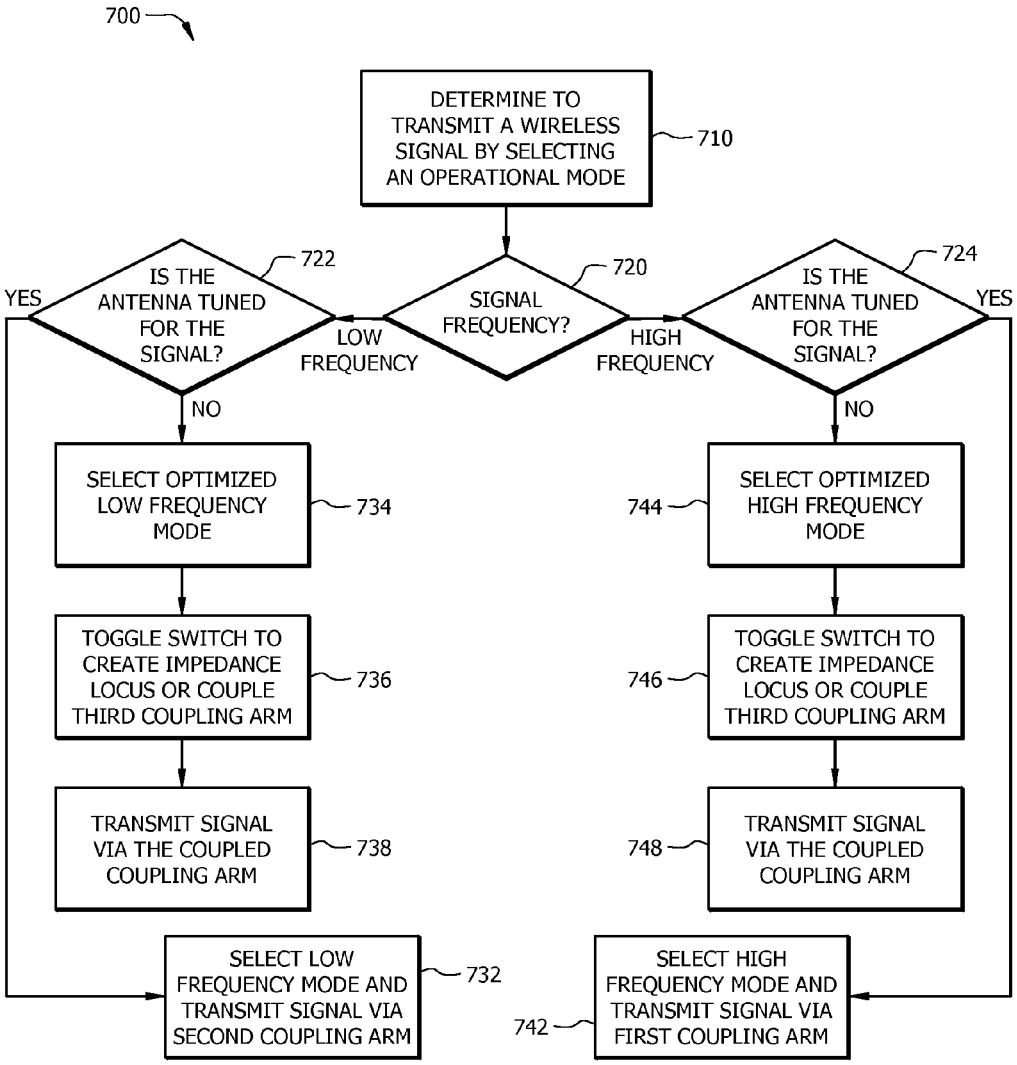
FIG. 7 is a flowchart of an embodiment of a method of selecting an operating mode for a segmented antenna.

FIG. 7 is a flowchart of an embodiment of a method 700 of selecting an operating mode for a segmented antenna, such as segmented antenna 500 and/or 601. Method 700 may employ a segmented antenna that comprises at least one switch (e.g. switch 591 and/or 592) connected to a coupling arm (e.g coupling arm 522 and/or 523). The switch may be toggled to create an impedance locus, decouple the main arm from a coupling arm and couple the main arm to a different coupling arm, or combinations thereof. In method 700, a MN, such as MN 600, may determine to transmit a wireless signal by selecting an operating mode at step 710. At step 720, the MN may determine the frequency of the signal. Method 700 may proceed to step 722 if the signal comprises a low frequency and step 724 if the signal comprises a high frequency. At step 722, the MN may determine whether the antenna is already tuned for the signal. If the antenna is already tuned for the signal, method 700 may proceed to step 732, select low frequency mode and transmit the signal across the antenna. The longer coupling arm (e.g. second coupling arm 523) may resonate and transmit the signal. If the antenna is not tuned for the signal, method 700 may proceed to step 734 and select optimized low frequency mode. At step 736, the method 700 may toggle the switch. Depending on the switch configuration, the switch may open a coupling arm and create an impedance locus in a manner similar to switch 591, which may increase impedance. As an example, a user's hand may increase antenna capacitance and the creation of an impedance locus may offset the capacitance and increase performance. In an alternate configuration, such as switch 592, the switch may decouple a coupling arm (e.g. second coupling arm 523) from the main arm (e.g. main arm 521) and couple another coupling arm (e.g. third coupling arm 524) to the main arm, which may result in altering the shape of the antenna loop and any related tuning. At step 738, the method 700 may transmit the signal via the coupled coupling arm (e.g. third coupling arm 524.) As with step 732, the longest coupled coupling arm may resonate and transmit the low frequency signal.

At step 724 method 700 may have determined that the signal is a high frequency signal. The method may then determine if the antenna is tuned for the signal. If the antenna is tuned for the signal, the method 700 may proceed to step 742, select high frequency mode, and transmit the signal. The shorter coupling arm (e.g. first coupling arm 522) may resonate and transmit the signal. If the antenna is not tuned for the signal, method 700 may proceed to step 744 and select optimized high frequency mode. At step 746, the method 700 may toggle the switch. The switch at step 746 may or may not be the same switch as the switch used at step 736. Depending on the configuration, toggling the switch at step 746 may optimize the antenna for high frequency signals in a similar manner to step 736 (e.g. creating an impedance locus and/or altering the antenna shape). At step 748, the method 700 may transmit the signal via the coupled coupling arm. As with step 742, the shortest coupled coupling arm may resonate and transmit the high frequency signal. It should be noted that the mode of operation may depend on the topology of the antenna and/or the operating frequencies of the antenna and associated circuit(s). As such, method 700 may be applied to multiple antenna embodiments with multiple switch and/or coupling arm configurations.

Figure 8:
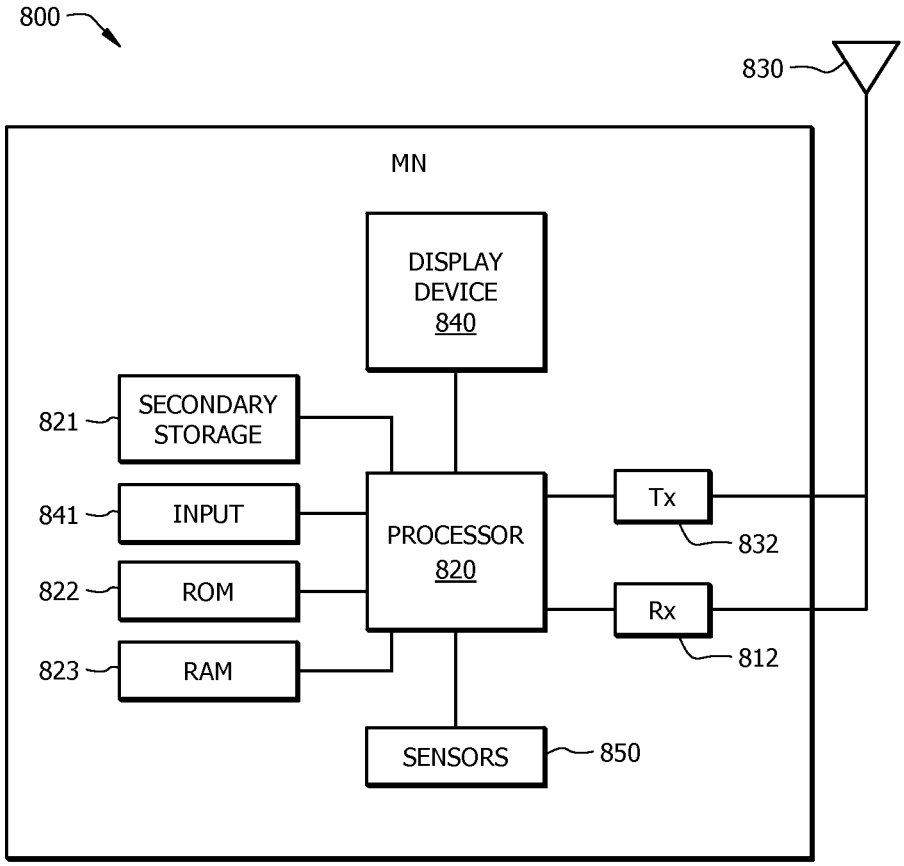
FIG. 8 is a schematic diagram of an embodiment of a MN.

FIG. 8 is a schematic diagram of an embodiment of a MN 800, which may comprise antenna 300, antenna 400, antenna 500, antenna 601, and may be substantially similar to MN 600. MN 800 may comprise a two-way wireless communication device having voice and/or data communication capabilities. In some aspects, voice communication capabilities are optional. The MN 800 generally has the capability to communicate with other computer systems on the Internet and/or other networks. Depending on the exact functionality provided, the MN 800 may be referred to as a data messaging device, a tablet computer, a two-way pager, a wireless e-mail device, a cellular telephone with data messaging capabilities, a wireless Internet appliance, a wireless device, a smart phone, a mobile device, or a data communication device, as examples.

MN 800 may comprise a processor 820 (which may be referred to as a central processor unit or CPU) that may be in communication with memory devices including secondary storage 821, read only memory (ROM) 822, and random access memory (RAM) 823. The processor 820 may be implemented as one or more general-purpose CPU chips, one or more cores (e.g., a multi-core processor), or may be part of one or more application specific integrated circuits (ASICs) and/or digital signal processors (DSPs). The processor 820 may be implemented using hardware, software, firmware, or combinations thereof.

The secondary storage 821 may be comprised of one or more solid state drives and/or disk drives which may be used for non-volatile storage of data and as an over-flow data storage device if RAM 823 is not large enough to hold all working data. Secondary storage 821 may be used to store programs that are loaded into RAM 823 when such programs are selected for execution. The ROM 822 may be used to store instructions and perhaps data that are read during program execution. ROM 822 may be a non-volatile memory device may have a small memory capacity relative to the larger memory capacity of secondary storage 821. The RAM 823 may be used to store volatile data and perhaps to store instructions. Access to both ROM 822 and RAM 823 may be faster than to secondary storage 821.

MN 800 may be any device that communicates data (e.g., packets) wirelessly with a network. The MN 800 may comprise a receiver (Rx) 812, which may be configured for receiving data, packets, or frames from other components. The receiver 812 may be coupled to the processor 820, which may be configured to process the data and determine to which components the data is to be sent. The MN 800 may also comprise a transmitter (Tx) 832 coupled to the processor 820 and configured for transmitting data, packets, or frames to other components. The receiver 812 and transmitter 832 may be coupled to an antenna 830, which may be configured to receive and transmit wireless (radio) signals. As an example, antenna 830 may comprise and/or be substantially similar to antenna 300, 400, 500, and/or 601, respectively. As another example, Tx 832 may comprise and/or be substantially similar to signal feed 325, 425, and/or 525.

The MN 800 may also comprise a device display 840 coupled to the processor 820, for displaying output thereof to a user. The device display 840 may comprise a light-emitting diode (LED) display, a Color Super Twisted Nematic (CSTN) display, a thin film transistor (TFT) display, a thin film diode (TFD) display, an organic LED (OLED) display, an active-matrix OLED display, or any other display screen. The device display 840 may display in color or monochrome and may be equipped with a touch sensor based on resistive and/or capacitive technologies.

The MN 800 may further comprise input devices 841 coupled to the processor 820, which may allow a user to input commands to the MN 800. In the case that the display device 840 comprises a touch sensor, the display device 840 may also be considered an input device 841. In addition to and/or in the alternative, an input device 841 may comprise a mouse, trackball, built-in keyboard, external keyboard, and/or any other device that a user may employ to interact with the MN 800. The MN 800 may further comprise sensors 850 coupled to the processor 820. Sensors 850 may detect and/or measure conditions in and/or around MN 800 at a specified time and transmit related sensor input and/or data to processor 820.

It is understood that by programming and/or loading executable instructions onto the MN 800, at least one of the processor 820, antenna 830, Tx 832, Rx 812, sensors 850, display device 840, RAM 823, ROM 822, secondary storage 821, and/or input 841 are changed, transforming the MN 800 in part into a particular machine or apparatus, e.g., a multi-core forwarding architecture, having the novel functionality taught by the present disclosure. It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an ASIC, because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, Ru, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 7 percent, . . . , 70 percent, 71 percent, 72 percent, . . . , 97 percent, 96 percent, 97 percent, 98 percent, 99 percent, or 100 percent. Moreover, any numerical range defined by two R numbers as defined in the above is also specifically disclosed. The use of the term "about" means ±10% of the subsequent number, unless otherwise stated. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural, or other details supplementary to the disclosure.

While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

What is claimed is:

1. A mobile node (MN) comprising:
an antenna comprising a first loop,
wherein the first loop comprises:
a main arm;
a first coupling arm separated from the main arm by an impedance locus;
a signal feed coupled to the main arm; and
a ground coupled to the first coupling arm, and wherein the first coupling arm is not coupled to the signal feed;
wherein the first coupling arm is configured to be electrically coupled to the main arm across the impedance locus by an electromagnetic field, and
wherein the first coupling arm and the main arm are not directly physically connected to each other.

2. The MN of claim 1, wherein the antenna comprises a second loop,
wherein the second loop comprises:
the main arm;
a second coupling arm separated from the main arm by a second impedance locus; and
the ground,
wherein the second coupling arm is electrically coupled to the main arm across the second impedance locus.

3. The MN of claim 2 further comprising at least one electromagnetic component configured to perform functions unrelated to the antenna, wherein the at least one electromagnetic component is positioned inside the first loop, the second loop, or combinations thereof.

4. The MN of claim 3, wherein the at least one electromagnetic component comprises a speaker, a microphone, a universal serial bus (USB), or combinations thereof.

5. The MN of claim 2, wherein the first loop is configured to transmit wireless signals of greater than about 1000 megahertz (MHz), and wherein the second loop is configured to transmit wireless signals of less than or equal to about 1000 MHz.

6. The MN of claim 2 further comprising a plurality of edges, wherein the first coupling arm is positioned along an edge, and wherein the second coupling arm is positioned along the edge.

7. The MN of claim 1 further comprising an antenna controller, wherein the antenna further comprises at least one switch, and wherein the antenna controller is configured to toggle the switch to alter a shape of an active portion of the first loop, create a third impedance locus in the first loop, or combinations thereof.

8. A method comprising:
selecting an operational mode for a loop antenna, wherein the loop antenna comprises:
a main arm;
a first coupling arm separated from the main arm by a span of nonconductive material, wherein the first coupling arm is configured to be electrically coupled to the main coupling arm across the span of nonconductive material by an electromagnetic field and wherein the first coupling arm and the main arm are not directly physically connected to each other; and a switch connected to the coupling arm;

placing the loop antenna in the selected operational mode by altering an electrical coupling of the loop antenna via toggling of the switch; and transmitting a wireless signal via the loop antenna.

9. The method of claim 8, wherein toggling the switch creates a high impedance locus along the first coupling arm and creates the electrical coupling across the high impedance locus.

10. The method of claim 8, wherein the loop antenna further comprises a second coupling arm, and wherein toggling the switch alters a shape of the loop antenna by:

decoupling the main arm from the first coupling arm; and electrically coupling the main arm to the second coupling arm.

* * * * *